United States Patent [19]

Jonasson

[11] 4,313,285

[45] Feb. 2, 1982

[54] STABILIZING DEVICE

[76] Inventor: Bertil Jonasson, Box 45, S-340 22 Eneryda, Sweden

[21] Appl. No.: 142,501

[22] Filed: Apr. 21, 1980

[30] Foreign Application Priority Data

Apr. 25, 1979 [SE] Sweden ..... 7903613

[51] Int. Cl.[3] ..... B24B 21/00

[52] U.S. Cl. ..... 51/135 R; 51/148

[58] Field of Search ..... 51/135 R, 135 BT, 148

[56] References Cited

U.S. PATENT DOCUMENTS

| | | | |
|---|---|---|---|
| 543,155 | 7/1895 | Linn | 51/135 R |
| 2,597,256 | 5/1952 | Murray | 51/135 BT |
| 2,783,593 | 3/1957 | Hercik | 51/135 R |
| 3,777,442 | 12/1973 | Bernu | 51/135 R |

*Primary Examiner*—Harold D. Whitehead

*Attorney, Agent, or Firm*—Beveridge, DeGrandi, Kline & Lunsford

[57] ABSTRACT

In a belt sanding machine comprising an elongated member (4) fastened at one end to the frame (5,8) of said machine and carrying the rollers thereof, the invention relates to a stabilizing device for fixing and stabilizing the elongated member, particularly the outer portion thereof, without obstructing exchange of sanding belt (3). The stabilizing device is characterized by a support member (7) pivotably fastened to the frame of said machine the elongated member being pressed against this support member substantially in the direction of the main operative load by deformation of the elongated member and/or the frame such deformation being achieved by a cylinder (15) mounted on the elongated member.

6 Claims, 2 Drawing Figures

STABILIZING DEVICE

BACKGROUND OF THE INVENTION

The present invention relates to a stabilizing device for supporting and fixing an elongated member being part of a machine. During operation this member is exposed to big loads but must be kept in an accurate position without vibrations in spite of the fact that only one end thereof is permanently fastened to the frame of the machine while the other end thereof must be readily accessible eg for placing an endless belt or the like around the elongated member.

In some types of wide belt sanding machines the sanding roller proper and usually also the idler roller are suspended from a horizontally protruding arm one end of which being fastened to the frame of the machine. This design is inevitable taking into account that it must be possible to place an endless sanding belt as a loop around the two rollers. During operation, in such a machine, there are created big loads mainly affecting the sanding roller proper. For this reason the mounting of the sanding roller to the arm and, of course also the mounting of the arm proper must be very rigid not to cause any adverse effect to the sanding. In a frequent size of machine of the type the horizontal arm usually has a length of at least one meter. This causes quite small loads to create big deformations of the arm if it is not very rigid and, furthermore, rigidly fastened to the frame of machine. In practice it has proved to be very difficult to design the arm and the mounting thereof in the frame with such a rigidity that the sanding can be performed without objections.

SUMMARY OF THE INVENTION

The practical efforts made to cure the vibrations, distortions or deflections of such an arm can be found in two different directions. Firstly, provisions have been made to design the arm and the mounting thereof in such a way that these components have an inherent rigidity big enough to provide for sufficient performance of the machine. Unfortunately, in such a design the dimensioning of the components in question will be such that this solution is not attractive. Secondly, it has also been tried to fasten or support the free end of the arm. To this end use has been made of different types of simple supports which, by means of conventional screws, have been fastened to the free end of the arm and the frame of the machine. No doubt, in this way there is achieved a rather good stabilizing of the arm so that adequate performance is achieved. However, this solution results in too time consuming and difficult labor when the sanding belt is to be exchanged as the supports have to be removed before exchange can be done and finally the supports be mounted again.

Therefore this invention has for its object to provide a device for locating and stabilizing an elongated member of a machine said member being exposed to forces and only one end thereof being permanently fastened to a frame of the machine while the other end being readily accessible for placing an endless belt or the like around the elongated member. This object is achieved if the inventive device comprises a support member fastened to the frame said support member being movable to a position for cooperating with a free end portion of said elongated member and one actuating device for pressing the free end of said elongated member to a precise location of stabilizing engagement with the support member by deforming said elongated member and/or said frame.

In practice one embodiment of the invention is characterized in that the support member has the shape of a yoke a first end of which is pivotably fastened to the frame and a second end of which receives the free end portion of the elongated member when in its position for cooperation with said elongated member, and in that the actuating device is designed as a cylinder fastened to said elongated member, the movable component thereof being movable, directly or indirectly, to a position pressing against the frame adjacent the first end of the yoke.

To guarantee that the position of the elongated member, ie the horizontal arm, always is the same even if the yoke has been pivoted away one or more times, eg for exchanging the belt as mentioned above, the inventive device is characterized in that the elongated member comprises an abutment for accurately locating the yoke and in that said yoke comprises adjustment means for accurately adjusting the position of the elongated member when being pressed against said yoke.

BRIEF DESCRIPTION OF THE DRAWINGS

The invention is now to be described more in detail reference is being made to the accompanying drawings. On these

DESCRIPTION OF A PREFERRED EMBODIMENT

Figure 1:
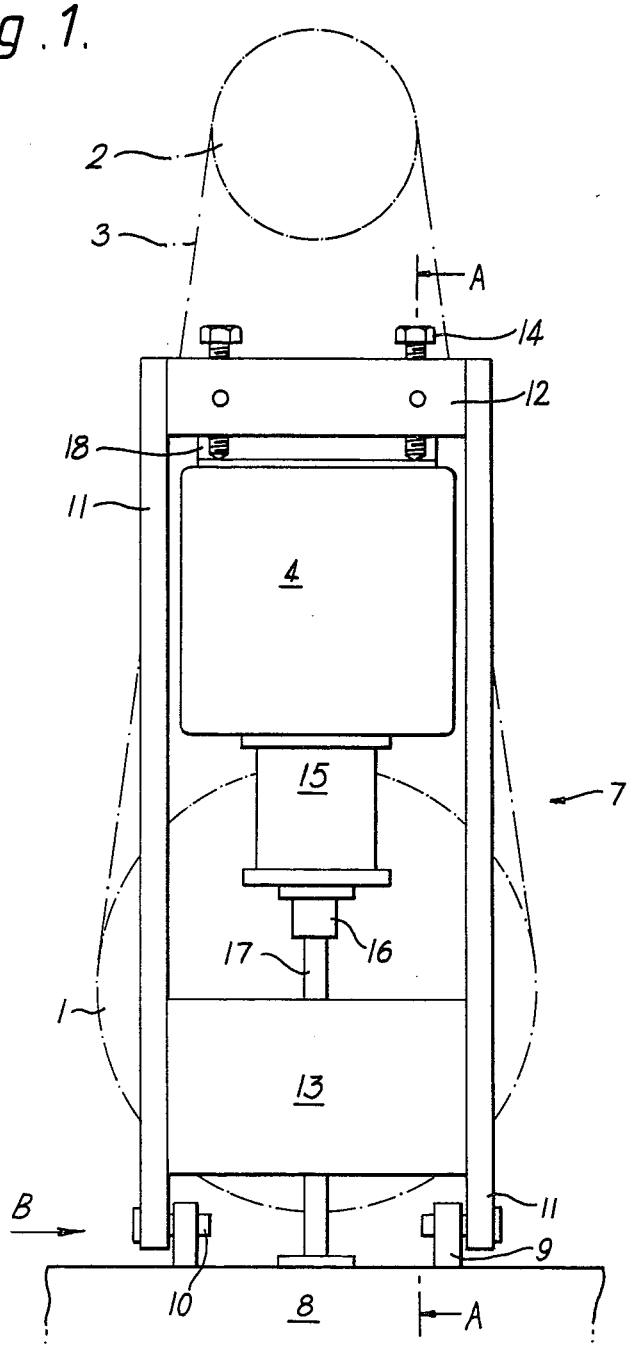
FIG. 1 shows schematically and as seen from its free end an arm being a component of a belt sanding machine of the type indicated above.

In FIG. 1 there is shown in the axial direction of the sanding rollers certain parts of a wide belt sanding machine well adapted for carrying the invention into effect. Thus, numeral 1 indicates the lower roller of the machine. This roller 1 is the working roller for sanding a work-piece being fed through the machine substantially along arrow B. Roller 2 in FIG. 1 is an idler roller and imparts tension to the belt indicated by numeral 3 and running as an endless loop around rollers 1 and 2. Both sanding roller 1 and idler roller 2 are carried in bearings mounted on an arm 4 extending with its longitudinal direction perpendicularly to the plane of drawing in FIG. 1. The inner end (as shown in FIG. 1) of arm 4 is permanently fastened to the frame of the machine. The detailed design of the means suspending rollers 1 and 2 do not form any part of the invention and could be designed in any way well known in the art.

Figure 2:
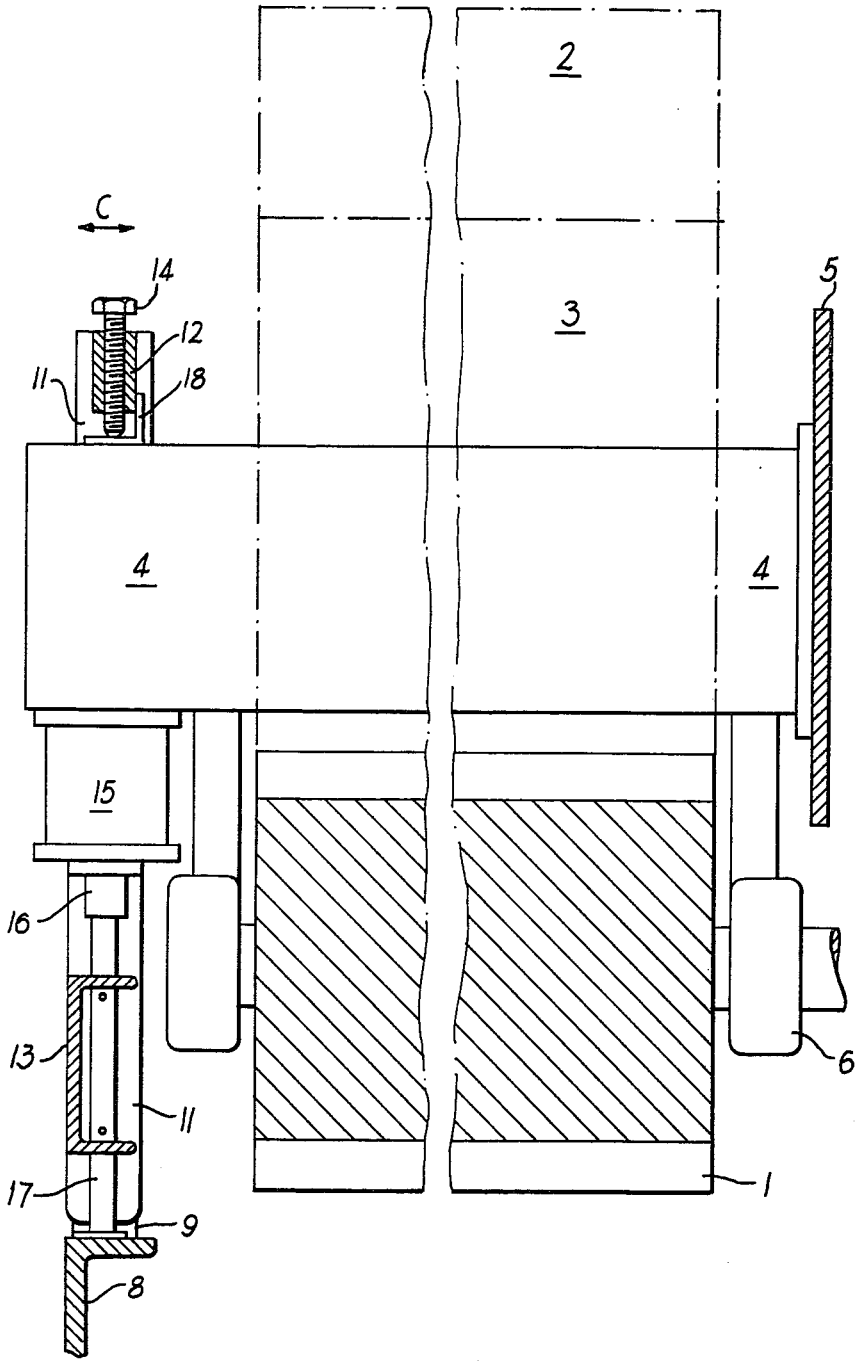
FIG. 2 shows a cross sectional view substantially on line A—A in FIG. 1.

FIG. 2 is a cross sectional view substantially on line A—A in FIG. 1 and shows that portion of the machine shown in FIG. 1. It should be pointed out, however, that for the sake of clarity the arm 4 proper is not shown in cross section in FIG. 2. In FIG. 2 is clearly seen that the inner end of arm 4, ie the end remote from the viewer in FIG. 1, is fastened in a manner not shown to the frame 5 of the machine. Such fastening can be accomplished by means of screws or rivets or by welding or in any other way. There is also indicated in FIG. 2 that sanding roller 1 is fastened to arm 4 via bearing brackets 6.

In operation the sanding roller 1 is pressed in an upward direction as seen in the figs due to the fact that the workpiece is pressed against the sanding roller. Furthermore, the sanding roller is exposed to a lateral force along arrow B in FIG. 1 this force being caused by the sanding action proper at the lower portion of the sanding roller and the workpiece. Both the contact force of the workpiece and the lateral sanding force (along arrow B) are transmitted to the horizontal arm and act thereon, partly upwardly in FIG. 2 and partly as a torsional moment acting on an axis parallel to the longitudinal axis of the arm. Apart from the above main types of loads against arm 4 said arm will also be exposed to dynamic loads, vibrations or similar loads having directions and magnitudes more or less difficult to predict. Taken together these loads implies that it is hardly possible to guarantee an accurate location of arm 4 in a static and exactely predetermined position even if the arm proper is sturdily dimensioned and rigidly fastened to frame 5.

To fix and stabilize arm 4 so it will not vibrate but will be retained in an accurately predetermined and static position also during hard operating the outer end of arm 4 must be supported in an effective manner without obstructing exchange of sanding belt 3. According to the invention such support is provided by a yoke 7 having its lower end pivotably fastened to a beam 8 constituting a part of frame 5. Such pivotable fastening of yoke 7 to beam 8 could be accomplished by means of lugs 9 fastened to beam 7 pivot pins 10 extending through the lugs and the lower ends of yoke 7. The legs 11 of yoke 7 connected with pivot pins 10 extend upwardly at both sides of the outer end (the free end) of arm 4 and are at their upper ends connected to each other by means of a first cross piece 12. Further, lower portions of legs 11 are connected to each other by means of a second cross piece 13. Apart from connecting the legs to each other cross piece 13 also has another purpose to be set out below. The upper cross piece having a cross sectional shape with a big vertical height (FIG. 2) is provided, adjacent the upper ends of legs 11, with two adjustment screws 14 each having a locking means. The screws 14 act as stop means which establish the amount of upward deflection of the arm 4 by the cylinder 15 described below. In proper positions of screws 14 and with the arm 4 in an unloaded condition the lower ends of the screws are situated a short distance above the upper surface of the arm 4. In this condition yoke 7 is pivotable as indicated by arrow C at least to a position in which it is extending horizontally out from beam 8. In this position of the yoke 7 the outer end of the arm 4 is easily accessible so that exchange of sanding belt 3 can be made without being obstructed by the yoke.

According to the invention the lower side of the free end portion of the arm 4 is provided with an actuating means which includes a cylinder 15 the piston rod 16 of which is facing downwardly and is engageable with a rod 17. Rod 17 is received in holes in the lower cross piece 13 and is displaceable in its longitudinal direction. The length of rod 17 is such that, if under influence of the piston rod, it could be brought to contact an abuttment on the upper side of the beam 8. Further acting on the rod by the piston rod results in an upward deformation or deflection of the arm 4 and/or the mounting thereof to frame 5. Thus, the force excerted by cylinder 15 against arm 4 has the same direction as the force pressing the work piece against sanding roller 1. This deformation of arm 4 and/or its mounting implies that the free end of the arm is lifted to engage the two adjustment screws 14 whereby further upward movement of the outer portion of the arm is prevented. Thus, by pressing upwardly the outer end portion of the arm 4 to engagement screws 14 the whole arm is fixed and stabilized in an accurate predetermined position.

As the yoke 7 is arranged in such a manner as to be exposed only to tension loads excerted by cylinder 15 the resulting deformation will be easily predicted and could be kept within very close limits. As a result a rather big force could be exerted by cylinder 15 in turn resulting in a very good stabilizing effect as regards torsional loads acting on the arm and caused by the sanding force between the lower portion of the sanding roller and the work piece. This stabilizing effect as regards torsional loads is further improved by placing the adjustment screws 14 spaced apart as long a distance as possible. Furthermore, due to the great pressure between the upper surface of arm 4 and adjustment screws 14 there is provided great frictional forces preventing deformation of the arm in directions perpendicular to the plane of the drawing in FIG. 2, ie to the right or left in FIG. 1.

To guarantee that the arm always comes to one and the same position at identical settings of adjustment screws 14 it is essential that the upper end of yoke 7 always is pivoted the same distance in over the outer portion of arm 4. This is achieved by providing on the upper side of arm 4 an abutment 18 engaging in the intended position the upper cross piece 12 of yoke 7.

The invention could be modified within the scope of the following claims. Thus, it is possible, departing from that stated above, to provide cylinder 15 either built into or on the top side of beam 8. This location of cylinder 15 as regards convenient pressure fluid supply and functional aspects is equivalent to the location described above. However, another location also possible in theory, ie on the pivotable yoke, is less attractive for practical reasons. It is also possible, without deteriorating the function, to pivotably fasten the upper end of the yoke 7 to the arm 4 while the lower end thereof could be brought to an adjustable position in cooperation with the beam 8 in which position upward movement of the yoke relative the beam is prevented. Finally, contrary to that stated above, the yoke need not extend to the upper side of the arm. Same good operation could be achieved if the outer end portion of arm 4 is provided, eg on its lower side, with a protruding member extending to the left in FIG. 2 the upper cross piece 12 of yoke 7 engaging this member.

Further modifications of the invention could be advantageous under certain conditions. If the effective sanding width is big ie the arm 4 is long, the lateral forces caused by the sanding action (to the left or right in FIG. 1) and acting on the arm could be great. In such a case it might be preferable to further improve the fixing and stabilizing of the free end of the arm by providing a second yoke pivotable about a vertical axis. In its position engaging the arm such a yoke relieves the lateral forces and, of course also, the torsional loads acting on the arm.

As an alternative to the pivotable yoke described above use could also be made of a stationary yoke having an upper cross piece pivotable about a vertical axis.

Further, the abuttment 18 on the arm 4 could be provided with recesses into which the adjustment screws 14 extend whereby the lateral loads are better transmitted from the arm to the yoke.

Finally, the yoke having a horizontal pivot axis could be arranged with this axis at an off-center location whereby the yoke tends to fall against abutment 18 when in vicinity thereof. Moreover, yoke 7 and/or frame 8 should be provided with a second abutment for keeping the yoke in a horizontal position when pivoted away from the arm 4. In this position the yoke constitutes a support surface for a sanding belt being changed.

I claim:

1. A belt sanding machine, comprising, a frame, a contact drum for receiving a sanding belt and holding it against a workpiece during operation of the machine, an elongated member supporting said contact drum, said elongated member having one end permanently fastened to the frame of the machine, actuating means operable between the frame of the machine and the elongated member for applying a deflection force to the elongated member, and stop means attached to the machine frame for preventing excessive deflection of the elongated member by said actuating means, said stop means and said actuating means being operable to fix and stabilize the elongated member at an accurate predetermined position, a support member which carries said stop means and is pivotally connected to said frame.

2. A belt sanding machine according to claim 1 wherein the stop means is located a short distance above the elongated member when the actuating means is deactivated, said actuating means being located below the elongated member.

3. A belt sanding machine according to claim 1 or claim 2 wherein the actuating means includes a fluid operated cylinder which is connected to the elongated member, said fluid operated cylinder having a piston rod which is displaceable to exert a force on said frame.

4. A belt sanding machine according to claim 1 or claim 2 wherein the stop means comprises two contact members which are spaced from each other to prevent said elongated member from twisting about its longitudinal axis.

5. A belt sanding machine according to claim 4 wherein said two contact members are adjustable in a direction which is parallel to the operative direction of the actuating means.

6. A belt sanding machine according to claim 4 wherein the actuating means includes a fluid operated cylinder which is connected to the elongated member, said fluid operated cylinder having a piston rod which is displaceable to exert a force on said frame.

* * * * *